US005409028A

United States Patent [19]

Lee

[11] Patent Number: 5,409,028

[45] Date of Patent: Apr. 25, 1995

[54] FRONT FRAME LIFTER FOR A WALKING SUPPORTER

[75] Inventor: Daniel Lee, Taipei, Taiwan, Prov. of China

[73] Assignee: Apex Medical Corp., Taipei, Taiwan, Prov. of China

[21] Appl. No.: 296,476

[22] Filed: Aug. 26, 1994

[51] Int. Cl.[6] ..... A45B 3/00

[52] U.S. Cl. ..... 135/66; 135/67; 280/47.35; 5/86.1

[58] Field of Search ..... 135/66, 67, 70, 65; 482/66, 68, 69, 139; 280/47.27, 47.28, 47.29, 47.35; 5/86.1

[56] References Cited

U.S. PATENT DOCUMENTS

| | | | |
|---|---|---|---|
| 3,469,269 | 9/1969 | Brown | 5/86.1 |
| 4,748,994 | 6/1988 | Schultz et al. | 135/67 |
| 4,920,590 | 5/1990 | Weiner | 5/86.1 |
| 4,981,412 | 1/1991 | Hawkins | 280/47.29 X |

*Primary Examiner*—Lanna Mai

*Attorney, Agent, or Firm*—Browdy and Neimark

[57] ABSTRACT

The present disclosure is related to a front frame lifter for use in a walking supporter. When encountering obstacles on a path, a user can let down a footboard through a controlling plate and then lift the front frame by means of leverage by stepping on the footboard. Thus, the user can pass through the obstacles easily. Moreover, the lifting device can be applied to other carts such as a shopping cart or a perambulator with the same effect.

1 Claim, 5 Drawing Sheets

FRONT FRAME LIFTER FOR A WALKING SUPPORTER

BACKGROUND OF THE INVENTION

The present invention relates to a lifting device for use on a walking supporter, especially to a front frame lifter secured to the rear frame of a walking supporter for easy lifting of the front wheels thereof by means of leverage in case of encounter of obstacles simply by a foot of a user.

A walking supporter is an indispensible aid to disabled patients paralyzed by apoplexy or suffered from accidents. A conventional walking supporter is comprised of a front frame 5, a rear frame 6 and a fixing device 7. The front frame 5 is mainly made up of a front supporter 51, therewith two connection tubes 52 are engaged at both sides. The connection tubes 52 can be adjusted by two tightening rods 521 to vary their lenghths thereof. The ends of the connection tubes 52 bent upwards to form a section of a grasping handle 53, thereto a brake device 54 is secured for control of the operation of back wheels 64.

Between the frame of the front supporter 51 are disposed a first lateral rod 55 and a metal twisted grille 56. Upon the lateral rod 55 is fixed by screws a horizontal board 551. Two rotary front wheels 57 are freely rotatably mountd to the bottom of the front supporter 51, and a stopping means 58 for limiting the rear frame 6 is disposed at the middle of the front supporter 51.

The rear frame 6 mainly has a rear supporter 61 having a second lateral rod 62 disposed at the top thereof for firmly binding both sides of the rear supporter 61 together. An L-shaped reinforcement round rod 63 in connection to the rear supporter 61 is engaged with both sides of the second lateral rod 62. Two back wheels 64 are secured to the bottom of the rear supporter 61. The fixing device is comprised of a securing plate 71 disposed at the front supporter 51, and a turning knob 72 having an entended bolt 721 in connection with the rear frame 6 through a fixing plate 73 disposed at the side of the rear supporter 61. The front supporter 51 and the rear supporter 61 are fixed together by way of the connection of the bolt 721 with the securing plate 71.

There are several disadvantages associated with the conventional walking supporter. A walking supporter is equipped at both the front frame and the rear frame with wheels. To pass through obstacles on a path, a user must lift the front wheels first and then the back wheels so as to move over the obstacles. It causes no problem for a user to lift the rear frame because it is located much closer to them. Yet when it comes to lift the front frame, it may cause great danger to the user, because it is situated relatively farther from the user; not only that it demands more effort, but also the user may easily fall due to a loss of balance when they lift the front frame with extra strength. Besides, most of the walking supporters are used by old people, it is a great inconvenience for them to use a conventional walking supporter when moving over obstacles on paths.

SUMMARY OF THE INVENTION

Therefore, the primary object of the present invention is to provide an improved walking supporter which is provided with a lifting device at one side of a rear frame. The front frame can be lifted by means of leverage when a user steps on a footboard secured on the rear frame and unfolded through a controlling plate, thereof the user can move over the obstacles with readiness.

Another object of the present invention is to provide an improved walking supporter having a lifting device which can be further applied to a shopping cart, a wheel chair or a baby cart, operated by way of hands to produce the same effect.

DETAILED DESCRIPTION OF THE PREFERRED EMBODIMENTS

Figure 1:
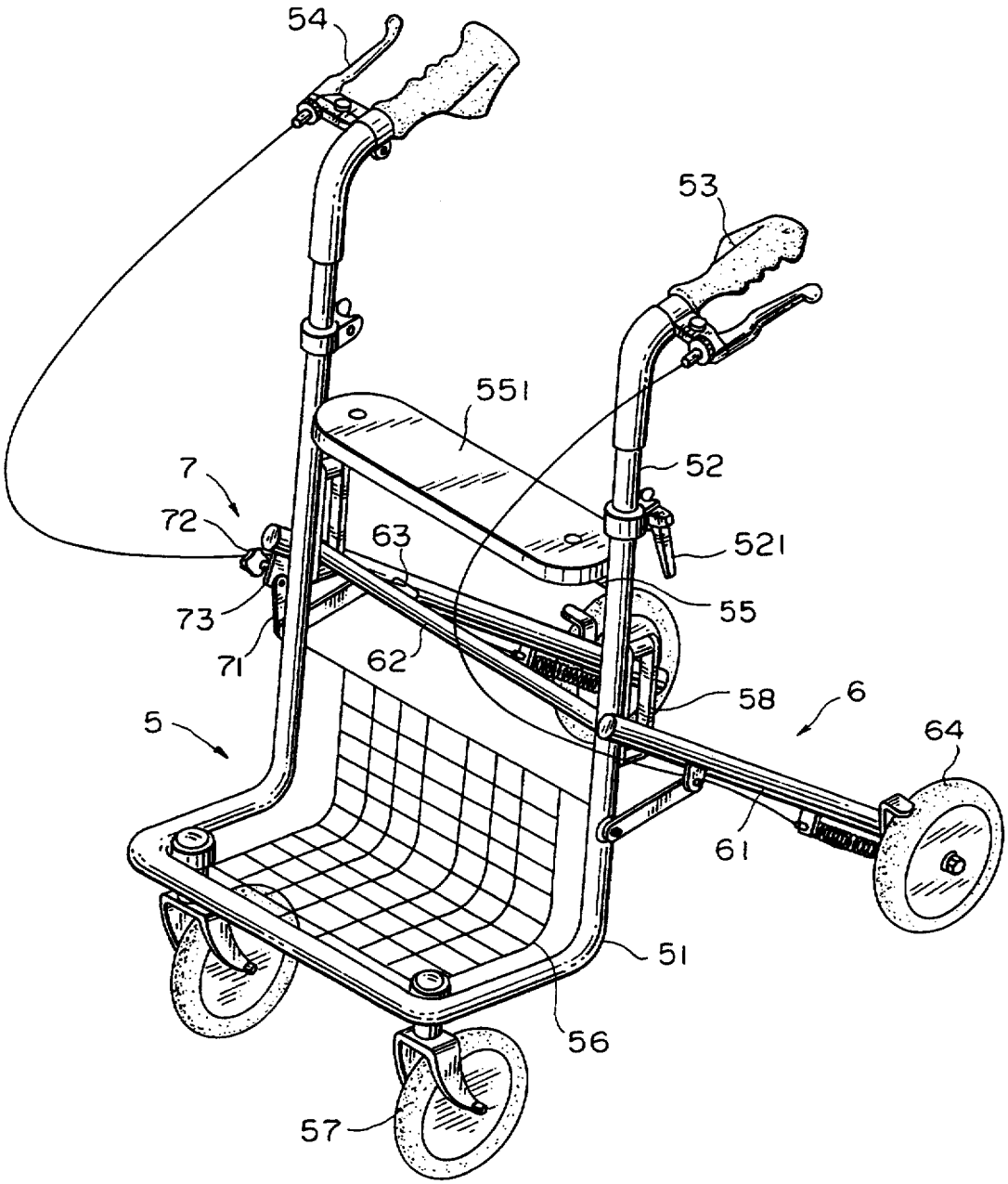
FIG. 1 PRIOR ART
FIG. 1 is a diagram showing a prior art walking supporter.
Figure 2:
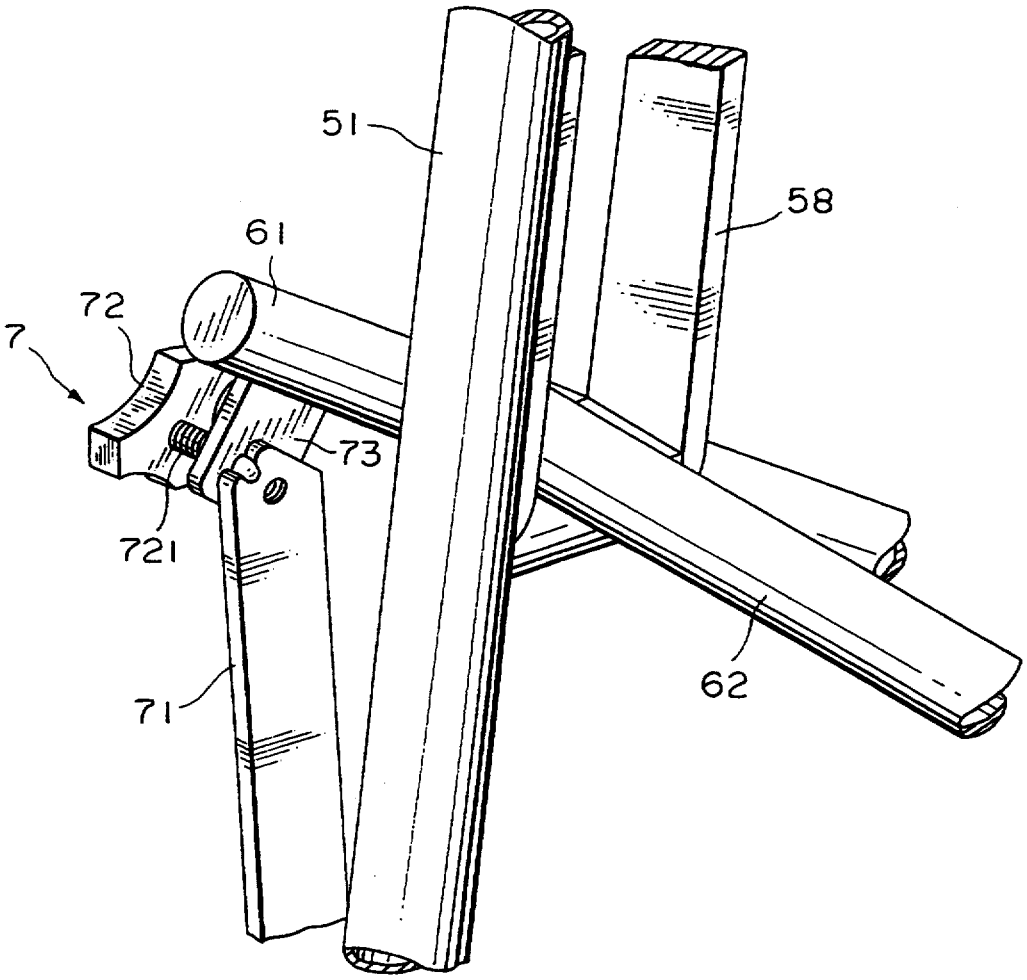
FIG. 2 PRIOR ART
FIG. 2 is a perspective diagram showing a prior art fixing device.

Referring to FIG. 1, a conventional walking supporter is comprised of a front frame 5, a rear frame 6 and a fixing device 7. The front frame 5 is mainly made up of a front supporter 51 having two connection tube 52 engaged with the ends thereof respectively. The connection tube 52 can be adjusted by actuation of two tightening rods 521 so as to get the connection tube 52 tightened up for fixing in place or loosened for extension, varying the length thereof.

The end of each connection tube 52 is bent into a right angle to form a grasping handle 53 to which is secured a hand brake 54.

Figure 3:
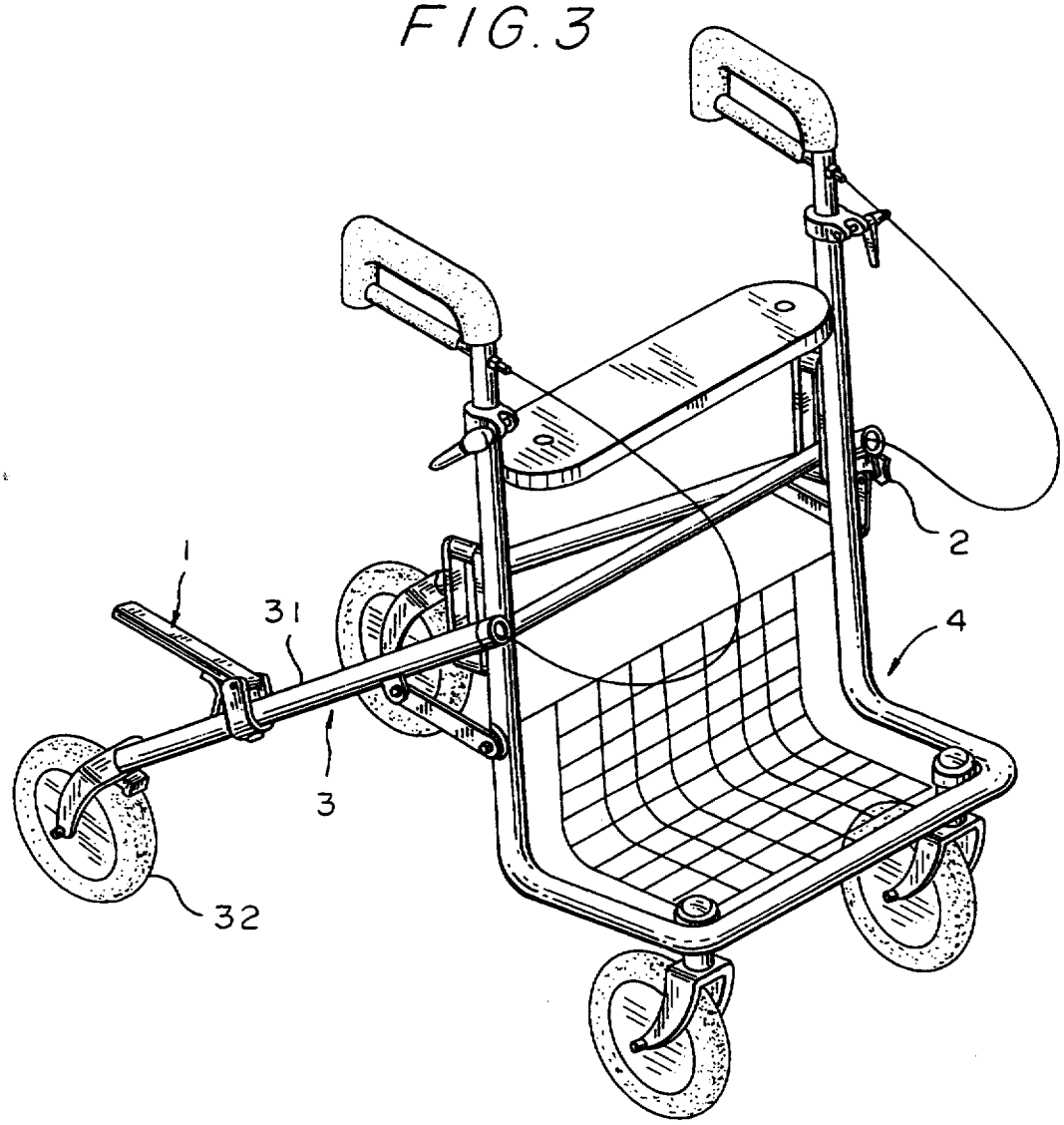
FIG. 3 is a perspective diagram of the present invention.

Referring to FIG. 3, the present invention relates to a front frame lifter for a walking supporter, comprising a front frame 4, a rear frame 3, a fixing device 2, and a lifting device 1, thereof the front frame 4, the rear frame 3 and the fixing device 2 are similar to the prior art.

Figure 4:
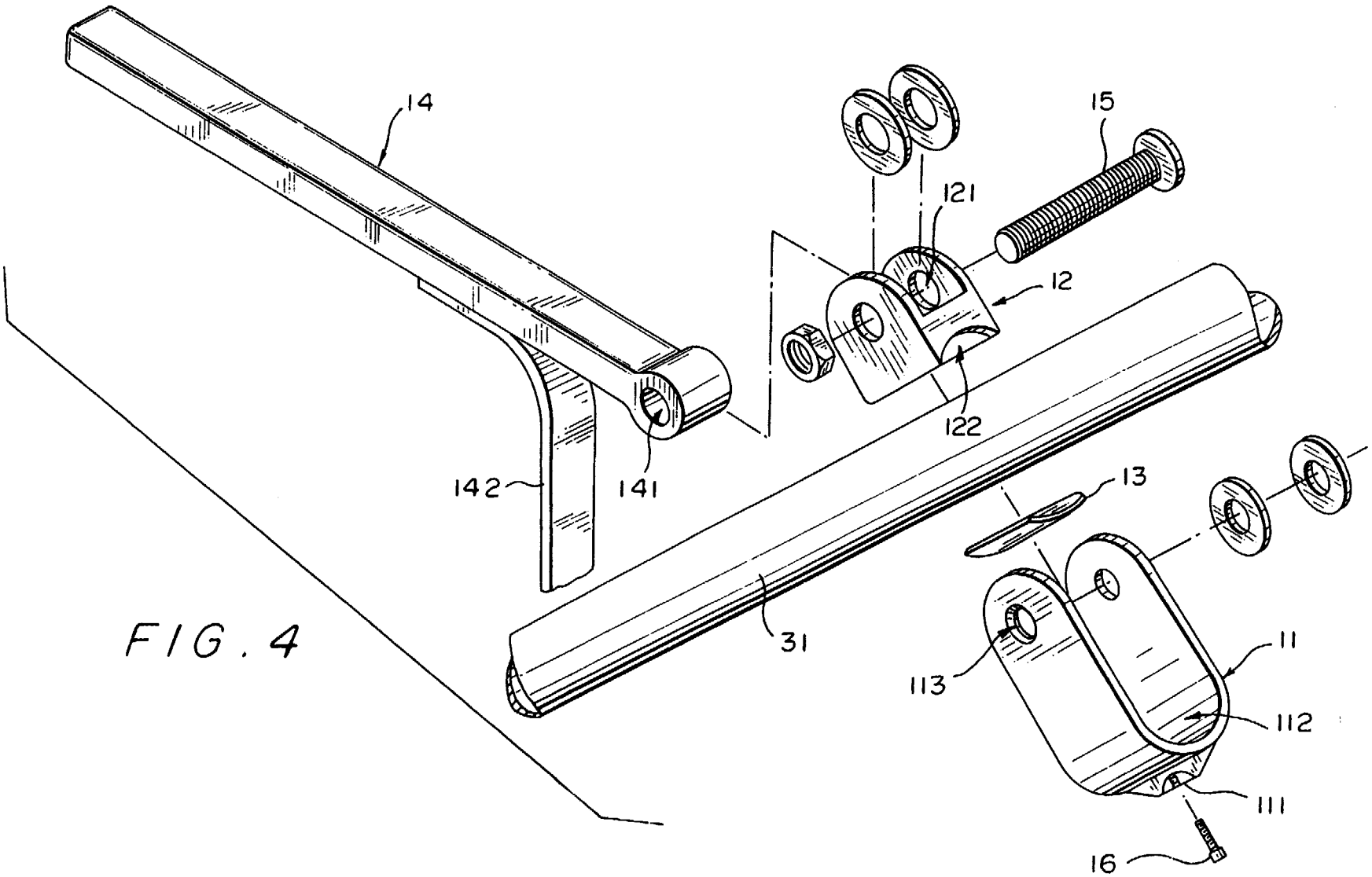
FIG. 4 is a perspective diagram showing the exploded components of a lifting device of the present invention.

Referring to FIG. 4, the front frame lifter 1 is engaged at the rear supporter 31 of the rear frame comprising of a locking member 11, a pivot member 12, a washer 13, a footboard 14, and a bolt 15. The locking member is U-shaped having a fixing hole 111 at the bottom of the locking member 11 to connect with the rear supporter by a screw 16. The middle part of the locking member 11 forms a hollow space 112 to engage the rear supporter 31 and the pivot member 12. At the top of the locking member 11 is disposed respectively a through hole 113, to which a connection hole 121 at the end of the pivot member 12 corresponds and connects. The bottom of the pivot member 12 has a groove 122 to engage through a washer 13 with the rear supporter 31. At the end of the footboard is a connection groove 141 to connect with the pivot member 12. At the bottom side of the footboard 14 is a controlling plate 142 to control the unfolding of the footboard 14. Through the through hole 113 and the connection hole 121, a bolt 15 is used to connect the locking member 11 and the pivot member 12 to the rear supporter 31. And through the bolt 15, the footboard 14 is connected to the pivot member 12.

Figure 5:
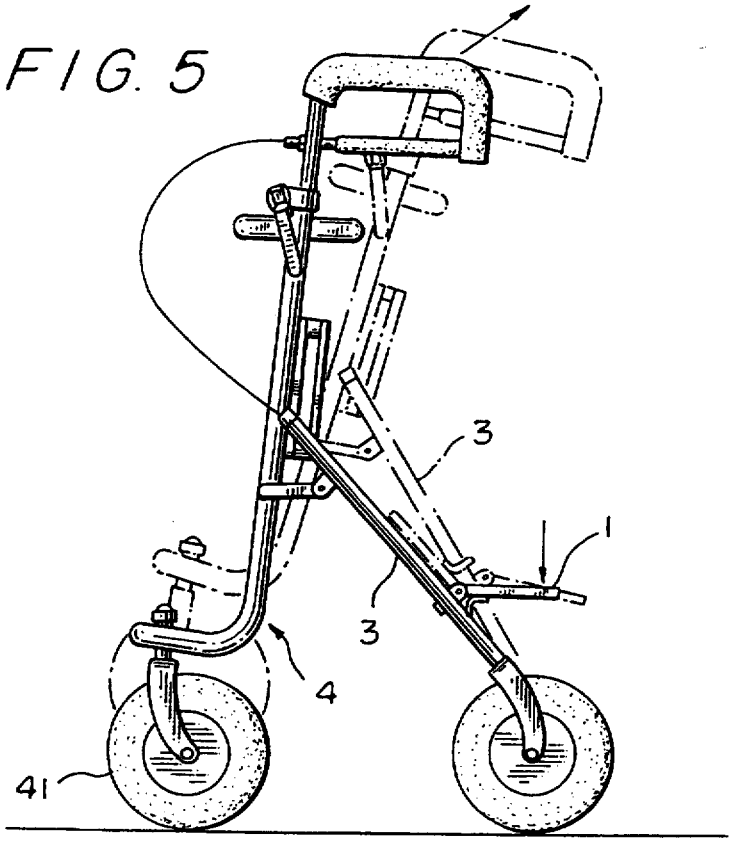
FIG. 5 is a diagram showing the operation of the present invention.

Referring to FIG. 5, in operation of the improved walking supporter, the footboard 14 can be let down through the controlling plate 142 when a user hooks the controlling plate by their feet. The front wheels 41 of the front frame 4 can be lifted and thus moved over obstacles by means of leverage when the user step on the footboard 14. When not in use, the footboard 14 can also be folded upwards, levelling with the rear supporter 31, so as to prevent a user's feet from scratching by the footboard 14.

Figure 6:
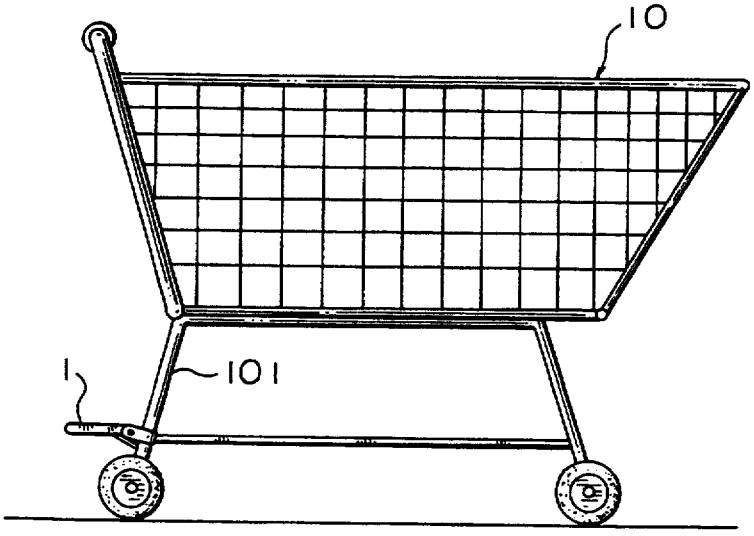
FIG. 6 is a diagram showing an application of the present invention to a shopping cart.

Referring to FIG. 6, the present invention can be mounted to the rear frame 101 of a shopping cart 10 with the same effect as stated above.

What is claimed is:

1. A front frame lifter used in combination with a walking supporter, comprising:

a front frame having wheels and a front supporter equipped with grasping handles each having brake means associated therewith to control the operation of wheels mounted to a rear frame;

said rear frame having the brake controlled wheels, made up of a rear supporter connected with the front frame by a fixing means;

the fixing means securing the front frame to the rear frame;

a lifting device engaged with the rear supporter, comprising a U-shaped locking member and a pivot member, said locking member having a fixing hole at its bottom to secure with the rear supporter by means of screw, a hollow space in its middle to engage both the rear supporter and the pivot member, and a through hole respectively on each side of its tops;

a pivot member having a connection hole to secure to the through hole of the locking member, a groove at its bottom to engage through a washer with the rear supporter; a footboard having a connection groove to connect to the pivot member and a controlling plate at its bottom side to control the unfolding operation thereof; and a bolt secures both the locking member and the pivot member to the rear supporter and the footboard to the pivot member, whereby the front frame can be lifted by means of leverage.

* * * * *